US005222365A

United States Patent [19]

Nenov

[11] Patent Number: 5,222,365

[45] Date of Patent: Jun. 29, 1993

[54] CRYOGENIC RECTIFICATION SYSTEM FOR PRODUCING HIGH PRESSURE NITROGEN PRODUCT

[75] Inventor: Neno T. Nenov, Williamsville, N.Y.

[73] Assignee: Praxair Technology, Inc., Danbury, Conn.

[21] Appl. No.: 840,268

[22] Filed: Feb. 24, 1992

[51] Int. Cl.[5] ..... F25J 3/00

[52] U.S. Cl. ..... 62/39; 62/87

[58] Field of Search ..... 62/39, 87

[56] References Cited

U.S. PATENT DOCUMENTS

| | | | |
|---|---|---|---|
| 3,210,947 | 10/1965 | Dubs et al. | 62/13 |
| 3,412,567 | 11/1968 | Smith | 62/39 |
| 3,756,035 | 9/1973 | Yearout | 62/39 |
| 4,072,023 | 2/1978 | Springmann | 62/39 |
| 4,357,153 | 11/1982 | Erickson | 62/39 |
| 4,400,188 | 8/1983 | Patel et al. | 62/13 |
| 4,464,188 | 8/1984 | Agrawal et al. | 62/13 |
| 4,662,916 | 5/1987 | Agrawal et al. | 62/13 |
| 4,662,917 | 5/1987 | Cormier et al. | 62/13 |
| 4,696,689 | 9/1987 | Mori et al. | 62/32 |
| 4,710,212 | 12/1987 | Hanson et al. | 62/23 |
| 4,769,055 | 9/1988 | Erickson | 62/22 |
| 4,775,399 | 10/1988 | Erickson | 62/22 |
| 4,777,803 | 10/1988 | Erickson | 62/22 |
| 4,834,785 | 5/1989 | Ayres | 62/38 |

FOREIGN PATENT DOCUMENTS 739316 6/1980 U.S.S.R. .

*Primary Examiner*—Ronald C. Capossela

*Attorney, Agent, or Firm*—Stanley Ktorides

[57] ABSTRACT

A cryogenic rectification system employing a coupled expander and compressor wherein a process stream employs system energy to drive the expander to compress product nitrogen while generating refrigeration to assist in carrying out the rectification thereby carrying out the rectification at a lower pressure.

7 Claims, 2 Drawing Sheets

CRYOGENIC RECTIFICATION SYSTEM FOR PRODUCING HIGH PRESSURE NITROGEN PRODUCT

TECHNICAL FIELD

This invention relates generally to the cryogenic rectification of mixtures comprising oxygen and nitrogen, e.g. air, and more particularly to the production of high pressure nitrogen product.

BACKGROUND ART

The cryogenic separation of mixtures such as air to produce nitrogen is a well established industrial process. Liquid and vapor are passed in countercurrent contact through one or more columns of a cryogenic rectification plant and the difference in vapor pressure between the oxygen and nitrogen causes nitrogen to concentrate in the vapor and oxygen to concentrate in the liquid. The lower the pressure is in the separation column, the easier is the separation due to vapor pressure differential. Accordingly, the final separation for producing product nitrogen is generally carried out at a relatively low pressure.

Often the product nitrogen is desired at a high pressure. In such situations, the product nitrogen is compressed to the desired pressure in a compressor. This compression is costly in terms of energy costs as well as capital costs for the product compressors.

Another way of producing high pressure nitrogen product is to operate the column or columns of the cryogenic air separation plant at an elevated pressure. This is disadvantageous because it makes the separation more difficult for any desired product purity level and also increases the burden on the base load air compressor which initially processes the feed air thus increasing the operating costs of the process.

Accordingly, it is an object of this invention to provide a cryogenic rectification system wherein product nitrogen may be efficiently produced while avoiding high operating pressures within the cryogenic rectification plant thus not burdening the base load air compressor with such high operating pressures.

SUMMARY OF THE INVENTION

The above and other objects which will become apparent to one skilled in the art upon a reading of this disclosure are attained by the present invention one aspect of which is:

A cryogenic rectification method for producing high pressure nitrogen comprising:

(A) compressing and cooling feed air, and passing cooled feed air into a cryogenic rectification plant comprising at least one column;

(B) separating feed air by cryogenic rectification in the cryogenic rectification plant to produce product nitrogen and a waste fluid;

(C) withdrawing product nitrogen from the cryogenic rectification plant, warming the withdrawn product nitrogen by indirect heat exchange with feed air to carry out the cooling of the feed air of step (A), and compressing the warmed product nitrogen through a compressor to produce high pressure product nitrogen;

(D) withdrawing waste fluid from the cryogenic rectification plant and expanding the withdrawn waste fluid through an expander coupled to the compressor thus simultaneously cooling the waste fluid and driving the compressor to carry out the product nitrogen compression of step (C); and (E) passing the cooled, expanded waste fluid in indirect heat exchange with feed air to further carry out the cooling of the feed air of step (A) and thus providing refrigeration into the cryogenic rectification plant.

Another aspect of this invention is:

A cryogenic rectification method for producing high pressure nitrogen comprising:

(A) compressing and cooling feed air, and expanding at least a portion of the compressed, cooled feed air through an expander coupled to a compressor thus further cooling the feed air;

(B) passing the further cooled feed air into a cryogenic rectification plant comprising at least one column;

(C) separating feed air by cryogenic rectification in the cryogenic rectification plant to produce product nitrogen;

(D) withdrawing product nitrogen from the cryogenic rectification plant and warming the withdrawn product nitrogen by indirect heat exchange with feed air to carry out the cooling of the feed air of step (A); and (E) compressing the warmed product nitrogen through the said compressor coupled to and driven by the said expander to produce high pressure nitrogen product while generating refrigeration within the expanding feed air which is provided into the cryogenic rectification plant.

Yet another aspect of the invention is:

A cryogenic rectification apparatus comprising:

(A) a base load compressor, a main heat exchanger, a cryogenic rectification plant comprising at least one column, means for providing fluid from the base load compressor to the main heat exchanger, and means for providing fluid from the main heat exchanger into the cryogenic rectification plant;

(B) an expander coupled to a compressor, means for passing product fluid from the cryogenic rectification plant to the main heat exchanger, means for providing product fluid from the main heat exchanger to the compressor, and means for recovering product fluid from the compressor; and (C) means for passing fluid through the expander thus driving the compressor.

As used herein, the term "column" means a distillation or fractionation column or zone, i.e., a contacting column or zone wherein liquid and vapor phases are countercurrently contacted to effect separation of a fluid mixture, as for example, by contacting of the vapor and liquid phases on vapor-liquid contacting elements such as on a series of vertically spaced trays or plates mounted within the column and/or on packing elements which may be structured and/or random packing elements. For a further discussion of distillation columns, see the Chemical Engineers' Handbook. Fifth Edition, edited by R. H. Perry and C. H. Chilton, McGraw-Hill Book Company, New York, Section 13, "Distillation", B. D. Smith, et al., page 13-3, *The Continuous Distillation Process.*

Vapor and liquid contacting separation processes depend on the difference in vapor pressures for the components. The high vapor pressure (or more volatile or low boiling) component will tend to concentrate in the vapor phase while the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification process carried out, at least in part, at low temperatures, such as at temperatures at or below 150 degrees K.

As used herein, the term "indirect heat exchange" means the bringing of two fluid streams into heat exchange relation without any physical contact or intermixing of the fluids with each other.

As used herein, the term "feed air" means a mixture comprising primarily nitrogen and oxygen such as air.

As used herein, the term "compressor" means a device for increasing the pressure of a gas.

As used herein, the term "expander" means a device used for extracting work out of a compressed gas by decreasing its pressure.

DETAILED DESCRIPTION

The invention will be described in detail with reference to the Drawings.

Figure 1:
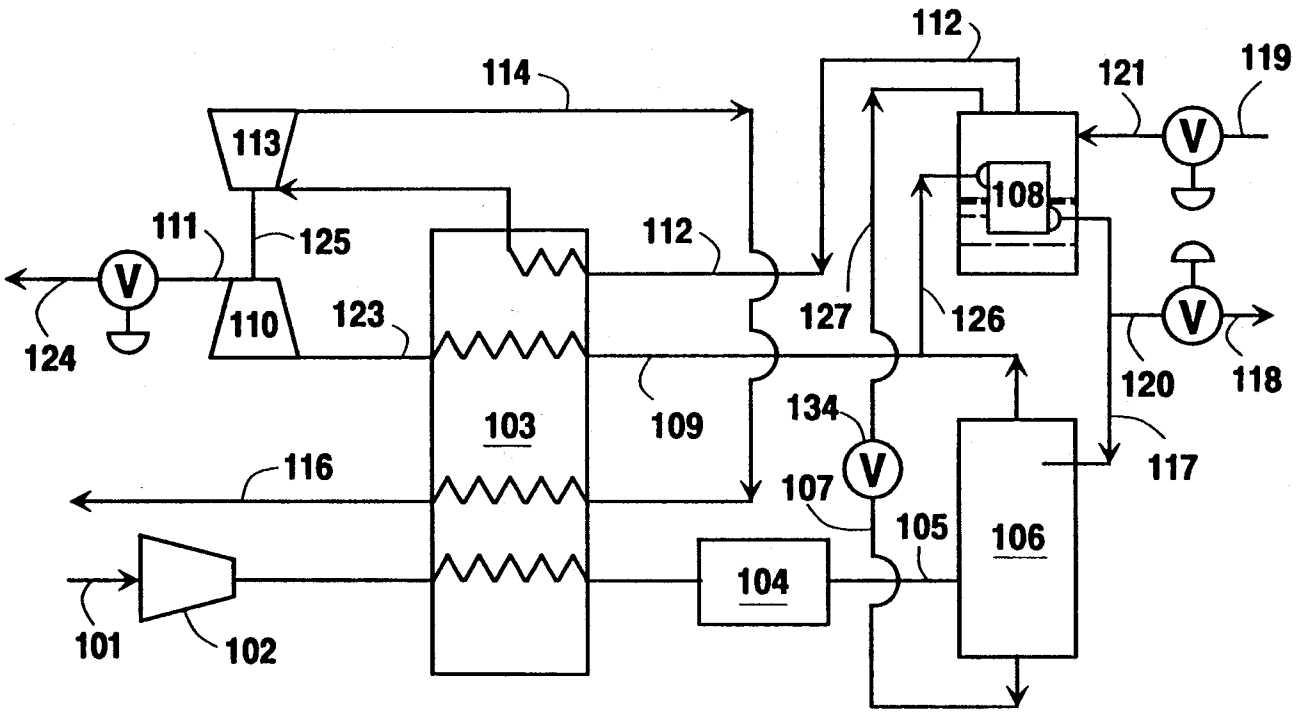
FIG. 1 is a schematic flow diagram of one preferred embodiment of the invention wherein the expander is driven by waste fluid from the cryogenic rectification plant.

Referring now to FIG. 1, feed air 101 is compressed in base load air compressor 102 and then passed through main heat exchanger 103 which, in the embodiment illustrated in FIG. 1, is a reversing type heat exchanger. Within main heat exchanger 103 the compressed feed air is cooled by indirect heat exchange with return streams as will be discussed in greater detail later. Since heat exchanger 103 is a reversing type heat exchanger, the feed air is cleaned by passage therethrough of high boiling impurities such as carbon dioxide and water vapor. The invention may also employ feed air prepurifiers in place of a reversing heat exchanger to clean the feed air. The compressed and cooled feed air is then passed through gel trap 104 for the removal of carbon dioxide and other impurities and then passed as stream 105 in a cryogenic rectification plant.

The cryogenic rectification plant illustrated in FIG. 1 comprises a single column 106 and a top condenser 108. It is preferred in the practice of this invention that the cryogenic rectification plant comprise one column although plants comprising more than one column may be employed. Column 106 preferably is operating at a pressure within the range of from 40 to 140 pounds per square inch absolute (psia).

Within column 106 the feed air is separated by cryogenic rectification into product nitrogen vapor ad a nitrogen-containing liquid. The product nitrogen vapor is withdrawn from the upper portion of column 106 having a purity of at least 99 percent nitrogen up to a purity of 99.9999 percent nitrogen or greater. A portion 126 of product nitrogen vapor 109 is passed into top condenser 108 wherein it is condensed against nitrogen-containing liquid and then passed as stream 117 back into column 106 as reflux. If desired, a portion 120 of stream 117 may be recovered as product liquid nitrogen 118. Nitrogen-containing liquid, having a nitrogen concentration generally within the range of from 60 to 70 percent, is removed from the lower portion of column 106 as stream 107, reduced in pressure through valve 134, and passed as stream 127 into top condenser 108 wherein it boils to carry out the condensation of stream 126. If desired, additional cryogenic liquid 119 may be passed into top condenser 108 as stream 121 to assist in this heat exchange.

The withdrawn product nitrogen vapor 109 is warmed by passage through main heat exchanger 103 in indirect heat exchange with feed air thereby cooling the feed air. Thereafter, the warmed product nitrogen 123 is compressed by passage through compressor 110 and resulting high pressure product nitrogen 111, at a pressure within the range of from 60 to 180 psia, is recovered as stream 124.

Nitrogen-containing waste fluid is withdrawn from top condenser 108 as stream 112 which then partially traverses main heat exchanger 103 and is then expanded through expander 113 to a pressure within the range of from 20 psia to atmospheric pressure. Expander 113 is coupled to compressor 110 by coupling means 125. In the directly coupled expander-compressor system, both devices are connected mechanically with or without a gear system so that the energy extracted from the expanding gas stream is passed directly by the expander via the compressor to the compressed product nitrogen gas. This arrangement minimizes both extraneous losses and capital expenditures associated with an indirect energy transfer from the expander to the compressor via an intermediate step of, for example, electric generation. As waste fluid 112 passes through expander 113, it drives the expander which then drives compressor 110 serving to carry out the compression of the product nitrogen. Simultaneously, the expanding waste fluid is cooled by passage through expander 113.

Cooled, expanded waste fluid 114 is then warmed by passage through main heat exchanger 103 in indirect heat exchange with feed air to further carry out the cooling of the feed air thus providing added refrigeration into the cryogenic rectification plant with the feed air to drive or carry out the cryogenic rectification. The resulting warmed waste fluid is removed from the system as stream 116.

Figure 2:
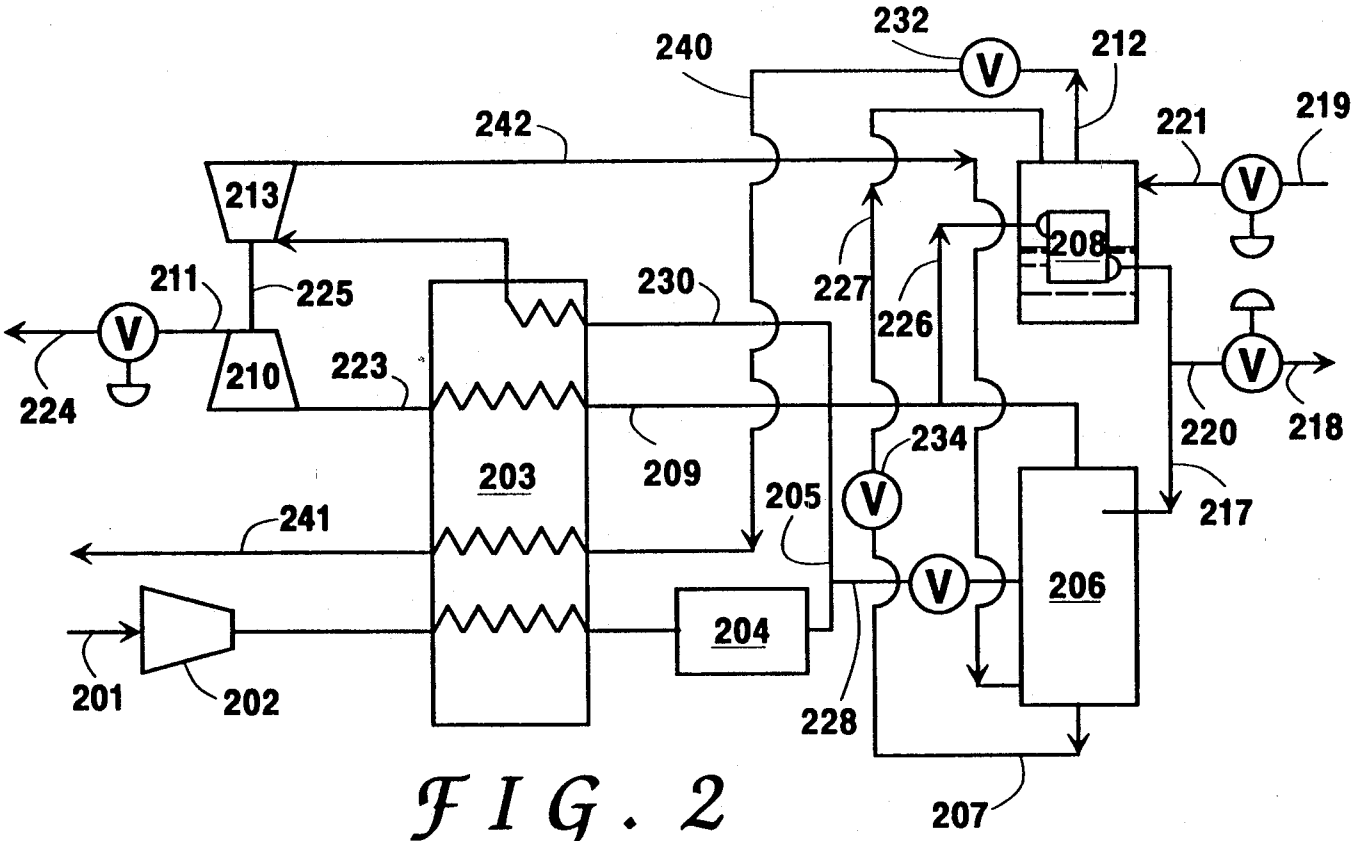
FIG. 2 is a schematic flow diagram of another preferred embodiment of the invention wherein the expander is driven by feed air.

FIG. 2 illustrates another embodiment of the invention wherein feed air rather than waste fluid is expanded through the expander for driving the product nitrogen compressor. The numerals in FIG. 2 correspond to those of FIG. 1 plus 100 for the elements common to both and these common elements will not be discussed again in detail.

Referring now to FIG. 2, waste fluid stream 212 is withdrawn from top condenser 208, reduced in pressure through valve 232 and resulting stream 240 is warmed by passage through main heat exchanger 203 in indirect heat exchange with compressed feed air and then removed from the system as stream 241.

Cooled, compressed feed air 205 is passed at least in part through expander 213. In the embodiment illustrated in FIG. 2, a portion 228 of the cooled compressed feed air is passed directly into column 206 and another portion 230 partially traverses main heat exchanger 203 and is then expanded through expander 213. The portion of the cooled, compressed feed air which is expanded through expander 213 may be within the range of from 90 to 100 percent of the cooled, compressed feed air. In the case where 100 percent of the cooled, compressed feed air is passed through expander 213, stream 228, as illustrated in FIG. 2, would not be present.

As the feed air passes through expander 213, it drives the expander which then drives compressor 210 by means of coupling 225 serving to carry out the compression of the product nitrogen. Simultaneously, the expanding feed air is cooled by passage through expander 213.

Cooled, expanded feed air 242 is then passed from expander 213 into column 206 of the cryogenic rectification plant thus providing refrigeration into the cryogenic rectification plant to drive or carry out the cryogenic rectification.

By means of the system of this invention, one can produce high pressure nitrogen while operating the cryogenic rectification plant at a pressure significantly less than the desired product pressure. This makes the cryogenic separation by rectification easier thus reducing both capital and operating costs for any given level of product nitrogen purity. Moreover, the burden on the base load compressor is reduced since the compressor does not operate against as high a pressure thus further reducing the operating costs of the system. The nitrogen product compressor is operated very efficiently due to its direct coupling to an expander which is driven by energy indigenous to the system with minimum dissipative losses. Additionally, the expanding fluid passing through the expander experiences a cooling effect which serves to pass added refrigeration into the cryogenic rectification plant to assist in driving or carrying out the cryogenic rectification.

Although the invention has been described in detail with reference to certain preferred embodiments, those skilled in the art will recognize that there are other embodiments of the invention within the spirit and the scope of the claims.

I claim:

1. A cryogenic rectification method for producing high pressure nitrogen comprising:

(A) compressing and cooling feed air, and passing cooled feed air into a cryogenic rectification plant comprising at least one column;

(B) separating feed air by cryogenic rectification in the cryogenic rectification plant to produce product nitrogen and a waste fluid;

(C) withdrawing product nitrogen from the cryogenic rectification plant, warming the withdrawn product nitrogen by indirect heat exchange with feed air to carry out the cooling of the feed air of step (A), and compressing the warmed product nitrogen through a compressor to produce high pressure product nitrogen;

(D) withdrawing waste fluid from the cryogenic rectification plant and expanding the withdrawn waste fluid through an expander coupled to the compressor thus simultaneously cooling the waste fluid and driving the compressor to carry out the product nitrogen compression of step (C); and (E) passing the cooled expanded waste fluid in indirect heat exchange with feed air to further carry out the cooling of the feed air of step (A) and thus providing refrigeration into the cryogenic rectification plant.

2. A cryogenic rectification method for producing high pressure nitrogen comprising:

(A) compressing and cooling feed air, and expanding at least a portion of the compressed, cooled feed air through an expander coupled to a compressor thus further cooling the feed air;

(B) passing the further cooled feed air into a cryogenic rectification plant comprising at least one column;

(C) separating feed air by cryogenic rectification in the cryogenic rectification plant to produce product nitrogen;

(D) withdrawing product nitrogen from the cryogenic rectification plant and warming the withdrawn product nitrogen by indirect heat exchange with feed air to carry out the cooling of the feed air of step (A); and (E) compressing the warmed product nitrogen through the said compressor coupled to and driven by the said expander to produce high pressure nitrogen product while generating refrigeration within the expanding feed air which is provided into the cryogenic rectification plant.

3. The method of claim 2 wherein the portion of the compressed, cooled feed air expanded through the expander is within the range of from 90 to 100 percent of the compressed, cooled feed air.

4. A cryogenic rectification apparatus comprising:

(A) a base load compressor, a main heat exchanger, a cryogenic rectification plant comprising at least one column, means for providing fluid from the base load compressor to the main heat exchanger, and means for providing fluid from the main heat exchanger into the cryogenic rectification plant;

(B) an expander coupled to a compressor, means for passing product fluid from the cryogenic rectification plant to the main heat exchanger and from the main heat exchanger to the compressor coupled to the expander, and means for recovering product fluid from the compressor coupled to the expander, said product recovery means not passing through the expander; and (C) means for passing fluid through the expander thus driving the compressor coupled to the expander, said fluid passing more comprising means for passing fluid from the cryogenic rectification plant to the expander and means for passing fluid from the expander to the main heat exchanger.

5. The cryogenic rectification apparatus of claim 4 wherein the cryogenic rectification plant comprises not more than one column.

6. A cryogenic rectification apparatus comprising:

(A) a base load compressor, a main heat exchanger, a cryogenic rectification plant comprising at least one column, means for providing fluid from the base load compressor to the main heat exchanger, and means for providing fluid from the main heat exchanger into the cryogenic rectification plant;

(B) an expander coupled to a compressor, means for passing product fluid from the cryogenic rectification plant to the main heat exchanger and from the main heat exchanger to the compressor coupled to the expander, and means for recovering product fluid from the compressor coupled to the expander, said product recovery means not passing through the expander; and (C) means for passing fluid through the expander thus driving the compressor coupled to the expander, said fluid passing means comprising means for passing fluid from the main heat exchanger to the expander and means for passing fluid from the expander to the cryogenic rectification plant.

7. The cryogenic rectification apparatus of claim 6 wherein the cryogenic rectification plant comprises not more than one column.

* * * * *